United States Patent [19]

Uzaki et al.

[11] Patent Number: 4,538,665

[45] Date of Patent: Sep. 3, 1985

[54] MOLDING BOX APPARATUS

[75] Inventors: Nagato Uzaki, Toyohashi; Toshihisa Komori, Okazaki; Kazuharu Matui; Shigehiro Toyoda, both of Toyokawa, all of Japan

[73] Assignee: Sintokogio Ltd., Nagoya, Japan

[21] Appl. No.: 473,615

[22] Filed: Mar. 9, 1983

[51] Int. Cl.[3] ..... B22C 9/12; B22C 9/20; B22C 15/22

[52] U.S. Cl. ..... 164/160.1; 164/244; 164/322

[58] Field of Search ..... 164/160.1, 133, 134, 164/136, 322, 323, 324, 350, 244

[56] References Cited

U.S. PATENT DOCUMENTS

| | | | |
|---|---|---|---|
| 3,463,221 | 8/1969 | Tillery | 164/350 X |
| 4,072,180 | 2/1978 | Hoult | 164/350 X |

FOREIGN PATENT DOCUMENTS

| | | | |
|---|---|---|---|
| 72254 | 2/1983 | European Pat. Off. | 164/322 |
| 56-131044 | 10/1981 | Japan | 164/160.1 |
| 7614080 | 6/1978 | Netherlands | 164/323 |
| 2110972A | 6/1983 | United Kingdom | 164/160.1 |
| 682318 | 8/1979 | U.S.S.R. | 164/323 |
| 774775 | 11/1980 | U.S.S.R. | 164/322 |

*Primary Examiner*—Nicholas P. Godici
*Assistant Examiner*—J. Reed Batten, Jr.
*Attorney, Agent, or Firm*—Armstrong, Nikaido, Marmelstein & Kubovcik

[57] ABSTRACT

A molding box apparatus having a horizontal tubular body and a pair of pattern plates having pattern surfaces complementary to the mold chambers to be formed fitting in the tubular body, at least one of the pattern plates being slidable in the tubular body. The apparatus further has a well pattern provided on the pattern surface of one of the pattern plates and a runner pattern provided on the well pattern and extending from one end of the latter substantially perpendicularly to the pattern surface. The end of the runner pattern is adapted to be slidingly received by a guide hole formed in the other pattern plate. With this apparatus, it is possible to easily produce a mold part of a vertical split type flaskless mold assembly.

6 Claims, 5 Drawing Figures

MOLDING BOX APPARATUS

BACKGROUND OF THE INVENTION

The present invention relates to a molding box apparatus suitable for forming a vertical split type flaskless mold assembly having mold parts arranged in a side-by-side relation, each unit being provided at both of its sides with cavity surfaces so that the contacting cavity surfaces of adjacent mold parts define a cavity therebetween, the mold assembly being further provided at its upper portion with a tunnel or cave like runner through which a molten metal is poured into the cavities.

As exemplarily shown in FIG. 4, a typical conventional flaskless mold assembly has a plurality of mold parts 44, 44 arranged in a side-by-side relation, each unit being provided at both of its sides with halves 42, 43 of a cavity 41 so that a multiplicity of cavities 41 are formed by the successive mold parts 44. In the use of this mold assembly, the pouring of molten metal into the cavities 41, 41 are made separately and independently for each of the cavities 41. This work is considerably troublesome and deteriorates the efficiency of the work seriously. In order to obviate this problem, tunnel or cave like runners are formed in the upper parts of the successive mold parts in communication with adjacent ones. The runners are connected through respective cavities through wells. In the casting, the molten metal is poured into the cavities through the continuous runners and wells. This type of mold assembly is disclosed in the specification of U.S. Pat. No. 4,072,180. This mold assembly, however, is difficult to produce. Particularly, the formation of the runner requires a troublesome manual work.

SUMMARY OF THE INVENTION

Accordingly, it is a primary object of the invention to provide a molding box apparatus capable of forming a tunnel or cave like runner while forming a vertical split type flaskless mold.

More specifically, an object of the invention is to provide a molding box apparatus capable of automatically forming a tunnel or cave like runner simultaneously with the formation of the cavity surfaces.

Another object of the invention is to provide a molding box apparatus which can charge the molding sand making use of vacuum force.

A still further object of the invention is to provide a molding box apparatus capable of forming a mold by means of a gas-hardenable molding sand.

To these ends, according to the invention, there is provided a molding box apparatus comprising: a horizontal tubular body provided in the center of upper wall thereof with a molding sand charging port; a pair of pattern plates opposing each other and fitting in the tubular body at both sides of the sand charging port, each of the pattern plates having a pattern surface of a configuration complementary to a part of a mold chamber to be formed; a well pattern placed on one of the pattern plates; a runner pattern disposed on the well pattern and extending from end surface of the well pattern substantially perpendicularly to the cavity surface; a guide hole formed in the other pattern plate and adapted to slidingly receive the end of the runner pattern; and means for slidingly driving at least one of the pattern plates in the tubular body.

Other objects, features and advantages of the invention will become clear from the following description of the preferred embodiment taken in conjunction with the accompanying drawings.

DESCRIPTION OF THE PREFERRED EMBODIMENTS

The invention will be fully described hereinunder with reference to the accompanying drawings.

Figure 1:
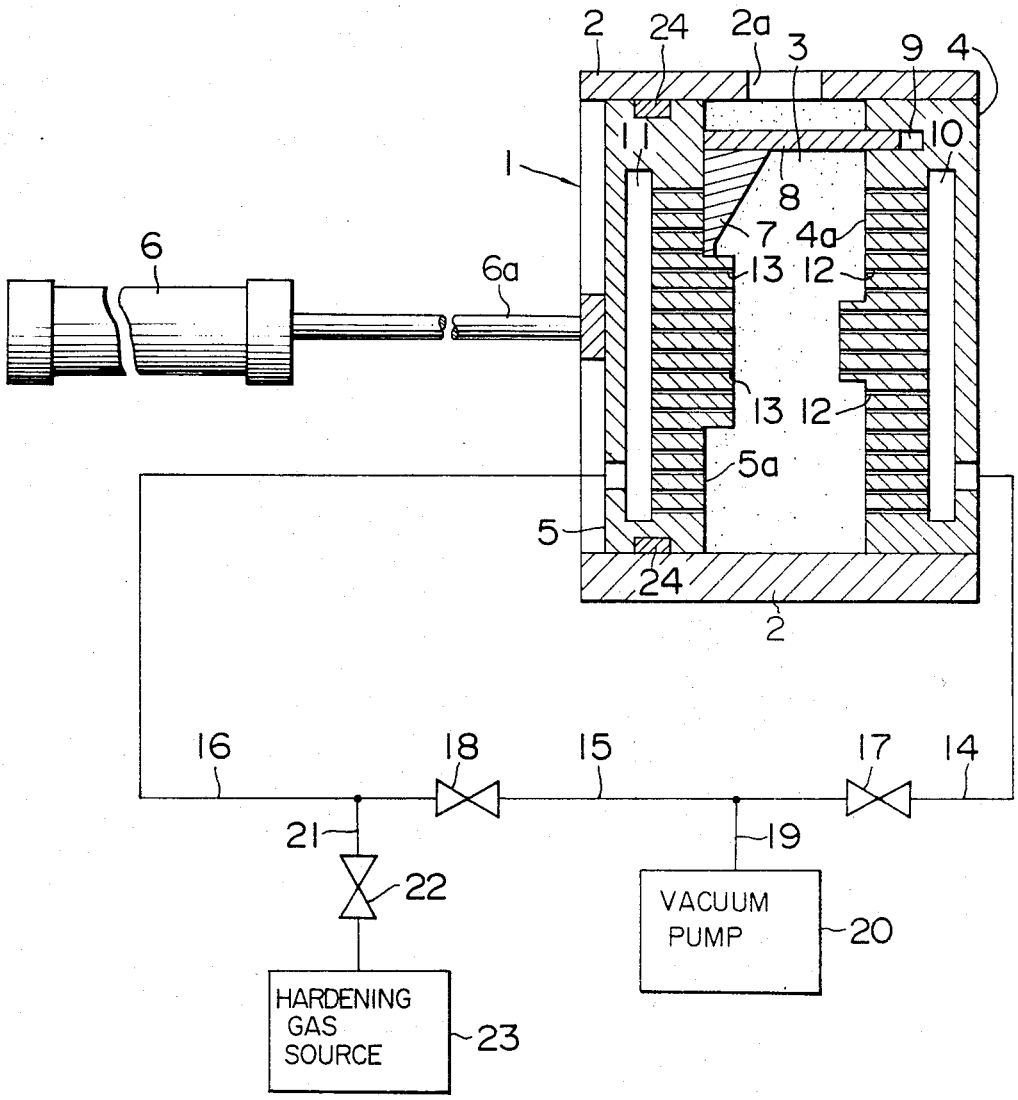
FIG. 1 is a partly-sectioned side elevational view of a molding box apparatus in accordance with an embodiment of the invention.

Referring first to FIG. 1, a molding box apparatus in accordance with an embodiment of the invention has a molding box generally designated by numeral 1 and mounted on a base which is not shown. The molding box 1 is constituted by a tubular body 2 having a rectangular cross-section and extending from the left to the right as viewed in the drawing and provided in its upper part with a molding sand charging port 2*a*, a stationary pattern plate 4 fitted in the right end of the tubular body 2 and provided at its left side with a pattern surface 4*a* for defining a mold chamber 3, and a movable pattern plate 5 fitted in and slidably received by the left end of the tubular body 2 and provided at its right side with a pattern surface 5*a* for defining the mold chamber 3. The movable pattern plate 5 is fixed to the end of a piston rod of a horizontal cylinder 6 fixed to the base which is not shown. The arrangement is such that, as the cylinder 6 operates to extend its piston rod 6*a*, the movable pattern plate 5 is moved to the right and is stopped temporarily to form a chamber which is slightly greater than the mold chamber 3 to be formed and, when the former chamber is formed molding sand is charged into this chamber by a vacuum sucking force as detailed hereinafter. A well pattern 7 for defining the shape of the well is disposed at the upper side of the pattern surface 5*a* of the movable pattern plate 5. A runner pattern 8 is placed on the well pattern 7. The runner pattern 8 has a length greater than the thickness of the mold part 31 shown in FIG. 2 and extends to the right from the position of the well pattern 7. A guide hole 9 for slidably receiving the end of the runner pattern 8 is formed in the pattern surface 4*a* so as to oppose the runner pattern 8. The stationary pattern plate 4 and the movable pattern plate 5 are provided with internal chambers 10 and 11, respectively. These internal chambers 10 and 11 are communicated with the pattern surfaces 4*a* and 5*a* of corresponding pattern plates 4 and 5 through a multiplicity of small passage holes 12, 12 and 13, 13, which are provided with vent plugs (not shown). The internal chambers 10 and 11 are connected to each other through conduits 14, 15 and 16. In the illustrated embodiment, stop valves 17 and 18 are disposed in the conduits 14 and 15, respectively. A vacuum pump 20 is connected to the conduit 15 through a branch pipe 19, while a hardening gas source 23 is connected to the conduit 16 through a branch pipe 21 having a stop valve 22. A sealing member 24 fits in a groove formed in the outer peripheral surface of the movable pattern plate 5.

The molding box apparatus of the invention having the construction explained hereinbefore operates in a manner explained hereinunder. The cylinder 6 operates to extend its piston rod 6*a* to slide the movable pattern plate 5 into the tubular body 2 with the runner pattern 8 being received by the guide hole 9 in the stationary pattern plate 4, thereby to form a chamber defined by the tubular body 2, stationary pattern plate 4 and a movable pattern plate 5. The operation of the cylinder is tentatively stopped as this chamber is reduced to a size which is somewhat greater than the expected mold chamber 3. Then, a hopper apparatus (not shown) storing molding sand containing a gas-hardenable binder is lowered to connect the discharge port of the apparatus to the sand charging port 2*a* in the tubular body and with the vacuum pump operating continuously, the stop valves 17 and 18 are opened to evacuate the chamber to reduce the pressure in the latter. Then, the discharge port is opened for a predetermined time length to permit the molding sand in the hopper to be sucked through the sand charging port 2*a* to fill the chamber. Then, after closing the stop valves 17 and 18, the cylinder 6 operates to further extend the piston rod 6*a* to drive the pattern plate 5 to the right thereby to reduce the chamber to the size of the predetermined mold chamber 3, so that the molding sand filling the chamber is compressed and compacted. Then, the hopper (not shown) is raised to disconnect its discharge port from the sand charging port 2*a* and the latter is covered air tight with a covering member (not shown). Then, the stop valves 17 and 22 are opened to relieve the hardening gas stored in the hardening gas source 23 and to introduce the same into the mold chamber 3 through the conduit 16, internal chamber 11 and small passage holes 13, 13. As a result, the hardening gas is made to penetrate the molding sand in the mold chamber 3. The gas which has penetrated and hardened the molding sand is then introduced into a neutralizing tank (not shown) attached to the vacuum pump 20, through the small passage holes 12, 12, internal chamber 10, conduit 14, stop valve 17 and a branch pipe 19. The gas is then relieved to the atmosphere after a neutralization. After lapse of the time required for the hardening of the molding sand, the stop valve 22 is closed to stop the supply of the hardening gas and, at the same time, the stop valve 17 is closed to stop the suction. Then, the cylinder 6 operates to retract its piston rod 6*a* thereby to move the movable pattern plate 5 to the left and, at the same time, parting pins (not shown) provided on the stationary pattern plate 4 are operated thereby to separate the hardened mold part 31 from the pattern surface 4*a* of the stationary pattern plate 4. In consequence, the mold part 31 attaching to the movable pattern plate 5 is moved to the outside of the tubular body accompanying the movable pattern plate 5. Then, parting pins (not shown) on the movable pattern plate 5 are made to operate to separate the mold part 31 from the pattern surface 5*a* of the movable pattern plate 5. Then the mold part 31 is manually moved to the right to withdraw the runner pattern 8 therefrom. The mold part 31 thus formed is provided on both of its sides with cavity surfaces which define, in combination with the cavity surfaces of adjacent mold parts, cavities 32 when a plurality of mold parts are arrayed in a side-by-side relation. Also, a surface constituting the well 33 is formed in the upper part of each mold part 31. Furthermore, a tunnel or cave like runner 34, communicating with the well 33, is formed in each mold part 31.

Figure 2:
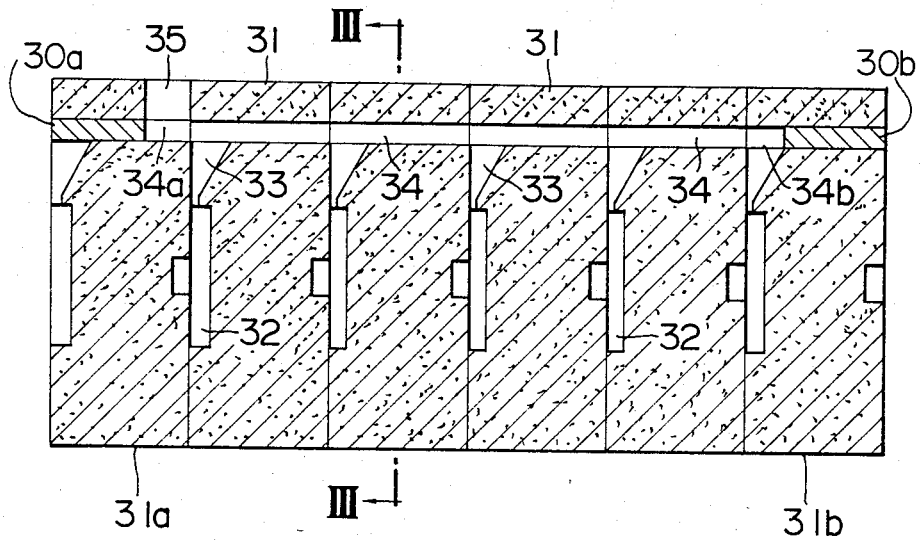
FIG. 2 is a vertical sectional view of a mold assembly formed by a molding box apparatus of the invention.
Figure 3:
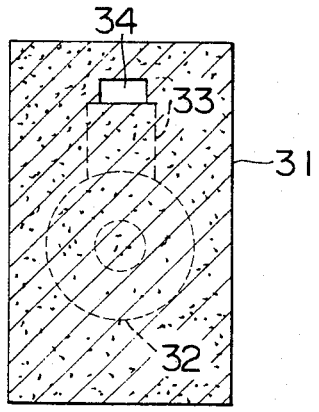
FIG. 3 is a sectional view taken along the line III—III of FIG. 2.
Figure 4:
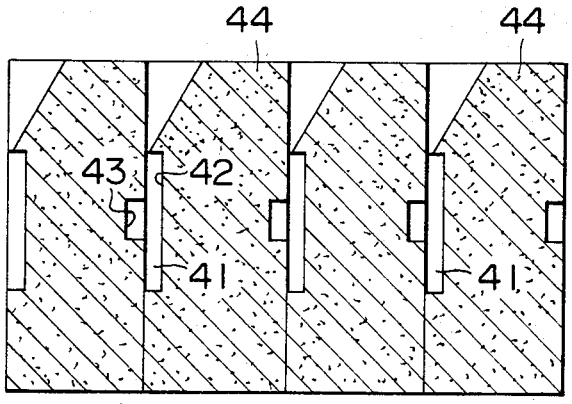
FIG. 4 PRIOR ART
FIG. 4 is a sectional side elevational view of a known vertical split type flaskless mold assembly.

As shown in FIG. 2, a plurality of mold parts 31 are arrayed in a side-by-side relation so that a multiplicity of cavities 32 are formed with the runners 34, 34 of the adjacent mold parts 31 being held in communication with one another. Both outer ends of the runners 34*a*, 34*b* of the outermost mold parts 31*a*, 31*b* are suitably closed by plugs 30*a*, 30*b* and a sprue 35 is formed to open in the upper surface of one 31*a* of the outermost mold parts in communication with the runner 34*a*. As the molten metal is poured through the sprue 35, the molten metal flows first into the cavity 32 of the mold part 31*a* of the left end through the well 33 and further into the cavity 32 of the next mold part through the runner 34. As the molten metal is supplied further, all cavities 32, 32 are successively filled with the molten metal.

Figure 5:
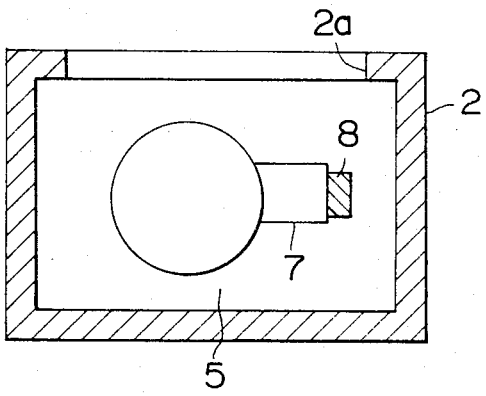
FIG. 5 is a sectional view of a molding box apparatus in accordance with another embodiment of the invention.

In the embodiment described hereinbefore, the well pattern 7 and the runner pattern 8 are formed just above the pattern surface 5*a*. This, however, is not exclusive and the positions of the pattern plate 5, well pattern 7 and the runner pattern 8 may be turned 90° from the position shown in FIG. 1 without changing the positional relationships as will be seen from FIG. 5. The mold part formed by the molding box apparatus shown in FIG. 5 is turned to the position shown in FIG. 2 when assembled together with other mold parts. It is also possible to make the pattern plate 4 slidable in the tubular body 2 as in the case of the movable pattern plate 5, although in the illustrated embodiment the pattern plate 4 is stationarily fixed to the tubular body 2. It is also possible to dispose the runner pattern on the other pattern plate 4 and the guide hole 9 in the pattern plate 5. According to such an arrangement, it is possible to compress and compact the molding sand in the mold chamber from both sides thereof.

It is to be understood also that the tubular body 2 can have a circular or polygonal cross-sectional shape, although in the illustrated embodiment the tubular body 2 has a rectangular cross-section. It is also possible to employ a blow-in type sand charging system making use of compressed air instead of the vacuum sucking type sand charging system employed in the described embodiment. In the described embodiment, the hardening of the molding sand is effected by both compaction and by penetration of gas which hardens the gas-hardenable binder contained by the molding sand. This, however, is only illustrative and the mold may be formed from green sand merely by squeezing.

As will be seen from the foregoing description, according to the invention, there is provided a molding box apparatus in which two pattern plates, each having a pattern surface of a configuration complementary to a part of the mold chamber to be formed, are accommodated by a tubular body in such a manner that at least one of these pattern plates is slidable in the tubular body. A well pattern and a runner pattern extending substantially perpendicularly to the pattern surface are disposed on the pattern surface of one of the two pattern plates, while the pattern surface of the other pattern plate is provided with a guide hole for receiving the runner pattern. In operation, the slidable pattern plate is slided deeper into the tubular body to form a chamber which is somewhat greater in size than the mold chamber to be formed and, after charging the molding sand into the former chamber, the pattern plate is further slided to reduce the size of this chamber to the size of the mold chamber to be formed to compact the molding sand and a hardening gas is supplied as desired to harden the sand, thereby to easily and surely form a mold part of a vertical split type flaskless mold having a tunnel or cave like runner and a well.

What is claimed is:

1. A molding box apparatus comprising:

a horizontal tubular body provided in the center of upper wall thereof with a molding sand charging port;

a pair of pattern plates opposing to each other and fitting in said tubular body at both sides of said sand charging port, each of said pattern plates having a pattern surface of a configuration complementary to a part of a mold chamber to be formed;

a well pattern placed on one of said pattern plates;

a runner pattern of a length greater than the width of a mold chamber to be formed disposed in contact with said well pattern and extending from an end surface of said well pattern substantially perpendicularly to said pattern surface;

a guide hole formed in the other pattern plate and adapted to slidingly receive the end of said runner pattern; and means for slidingly driving at least one of said pattern plates in said tubular body.

2. A molding box apparatus according to claim 1, wherein said well pattern is disposed at the upper side of said pattern surface.

3. A molding box apparatus according to claim 1, wherein the runner pattern is disposed beneath the top of said pair of pattern plates, whereby a molded article to be formed will have a tunnel like runner extending completely through said molded article.

4. A molding box apparatus according to claim 1, wherein said pattern plates are provided with respective internal chambers which are communicated with said pattern surfaces through a multiplicity of small passage holes having vent plugs and are connected to a vacuum pump through conduits and stop valves.

5. A molding box apparatus according to claim 4, wherein said conduits include two stop valves, and said vacuum pump is connected to the conduit between said stop valves through a branch pipe branching from said conduit.

6. A molding box apparatus according to either one of claims 4 and 5, wherein a hardening gas source is connected to a branch pipe which branches from one of the conduits through which said internal chambers are connected to said stop valves.

* * * * *